US008615959B2

(12) United States Patent
Ferguson et al.

(10) Patent No.: US 8,615,959 B2
(45) Date of Patent: Dec. 31, 2013

(54) FASTENER-LESS TRACK ASSEMBLY FOR SUPPORTING WALL STUDS

(75) Inventors: Harry B. Ferguson, Peachland (CA); Mervin S. Roshinsky, Westbank (CA)

(73) Assignee: Harmer Ventures Ltd., Peachland (CA)

( * ) Notice: Subject to any disclaimer, the term of this patent is extended or adjusted under 35 U.S.C. 154(b) by 0 days.

(21) Appl. No.: 13/057,266

(22) PCT Filed: Feb. 2, 2010

(86) PCT No.: PCT/CA2010/000145

§ 371 (c)(1),
(2), (4) Date: Jul. 12, 2011

(87) PCT Pub. No.: WO2011/094831

PCT Pub. Date: Aug. 11, 2011

(65) Prior Publication Data

US 2013/0000242 A1 Jan. 3, 2013

(51) Int. Cl.

| | |
|---|---|
| ***E04H 12/00*** | (2006.01) |
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 14/00*** | (2006.01) |
| ***E04B 2/82*** | (2006.01) |
| *E04C 3/04* | (2006.01) |

(52) U.S. Cl.

CPC ..... *E04B 2/825* (2013.01); *E04C 2003/0421* (2013.01)

USPC ..... 52/653.1; 52/241

(58) Field of Classification Search

USPC ..... 52/241, 481.1, 481.2, 653.1, 710, 656.9

See application file for complete search history.

(56) References Cited

U.S. PATENT DOCUMENTS

| | | | | |
|---|---|---|---|---|
| 2,173,721 | A | 9/1939 | McGee | |
| 3,536,345 | A | 10/1970 | Leifer | |
| 3,845,601 | A * | 11/1974 | Kostecky | 52/290 |
| 4,805,364 | A * | 2/1989 | Smolik | 52/241 |
| 5,325,651 | A | 7/1994 | Meyer | |
| 5,394,665 | A * | 3/1995 | Johnson | 52/241 |
| 5,797,233 | A | 8/1998 | Hascall | |
| 6,647,691 | B2 | 11/2003 | Becker | |
| 6,983,569 | B1 * | 1/2006 | Rosenberg | 52/241 |
| 2002/0020140 | A1 | 2/2002 | Sucre | |
| 2008/0168733 | A1 * | 7/2008 | Tollenaar | 52/481.1 |

FOREIGN PATENT DOCUMENTS

CA 2390083 A1 6/2002

* cited by examiner

*Primary Examiner* — William Gilbert
*Assistant Examiner* — Kyle Walraed-Sullivan
(74) *Attorney, Agent, or Firm* — Oyen Wiggs Green & Mutala LLP

(57) ABSTRACT

This application relates to a track assembly for supporting wall studs. The assembly includes an upper track and a lower track each having a base and opposed first and second sidewalls. A plurality of tabs are formed in the track sidewalls at spaced longitudinal intervals. Each tab defines a slot between the tab and an adjacent portion of the sidewall for slidably receiving a wall panel of a stud. The track assembly allows wall studs to be quickly and removably coupled to the tracks without the need for ladders, fasteners or special tools. In one embodiment the assembly is a slip track system permitting deflection of the upper track relative to the lower track after installation of the wall studs.

21 Claims, 8 Drawing Sheets

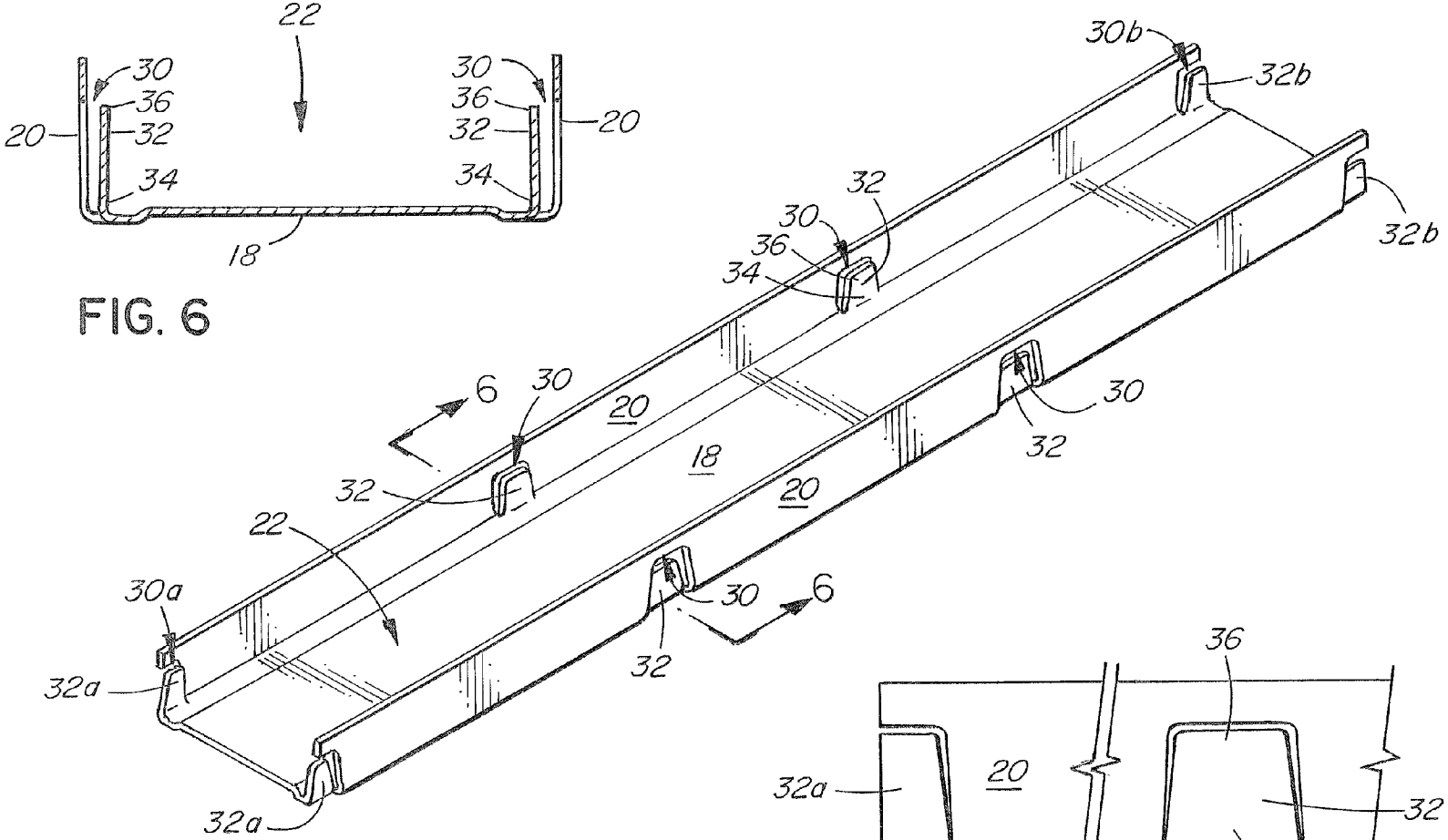
FIG. 5
FIG. 6
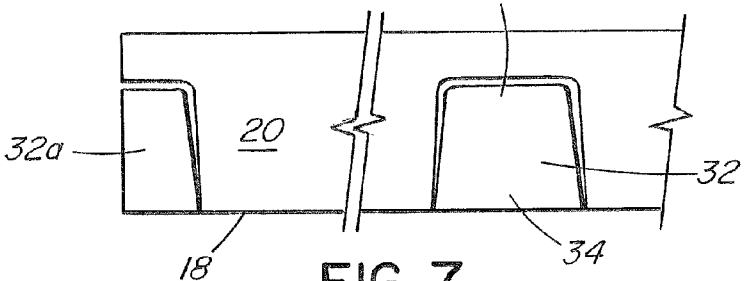
FIG. 7

FASTENER-LESS TRACK ASSEMBLY FOR SUPPORTING WALL STUDS

TECHNICAL FIELD

This application relates to track assemblies for supporting wall studs.

BACKGROUND

Metal wall studs are commonly used in the construction trade for framing walls and other structures. The studs are installed at spaced intervals to provide a framework for installation of drywall panels and the like.

Various track systems are known in the prior art for supporting wall studs at the desired location. Such systems typically comprise an upper track secured to the ceiling and a lower track secured to the floor in alignment with the upper track. Each wall stud is positioned between the upper and lower tracks and secured in place. In the case of "slip track" systems, the wall studs may be cut to a length less than the overall vertical distance between the upper and lower tracks. This permits some movement of the upper track relative to the lower track after installation of the wall studs. Slip track systems can thus accommodate deflection in the ceiling position relative to the wall and floor, for example due to changes in applied loads or temperature fluctuations. In some prior art systems an outer track and a movable inner track are provided to achieve the slip track functionality.

In conventional wall construction systems each stud is secured to the upper and lower tracks with fasteners, such as metal screws. This typically requires installers to use a ladder and a screw gun to secure the upper end of each stud to the upper track and building frame. The lower end of each stud is secured to the lower track in a similar manner. In some cases inexperienced tradesmen may install the studs at incorrect track locations, resulting in inconsistent spacing between the studs or off-vertical positioning. In such cases it is time-consuming and labour-intensive to remove the fasteners from the tracks and reinstall the wall studs in the correct orientation.

Some fastener-less stud alignment systems are known in the prior art where wall studs are held in place with clips or tabs formed in the tracks rather than by separate fasteners. Such systems avoid the need for screw guns or other tools for driving fasteners. However, in some cases the track clips are not designed to receive standard wall studs and custom studs must be used. In other cases studs cannot be easily extracted from the clips after installation, particularly in the case of heavier gauge studs.

U.S. Pat. No. 6,647,691, Becker et al., exemplifies the prior art in this field. Becker describes a track arrangement for supporting wall studs where the studs are held in place in the tracks with opposed clips. Each clip consists of a portion of track sidewall bent inwardly to form a cam surface and a stud ridge receiver. The studs may or may not be bottomed-out in the tracks depending on whether or not the wall is load bearing.

One drawback of the Becker track arrangement is that, once installed, the wall studs cannot be easily decoupled from the tracks. Rather, significant force would be required to extract the stud side flanges from the track clips. Also, the Becker arrangement requires that each stud be inserted within the upper and lower tracks in the same orientation, i.e. with stud side flanges projecting in one direction only.

The need has therefore arisen for a more versatile slip track assembly which permits simple removal and reinstallation of wall studs without the use of separate fasteners.

BRIEF DESCRIPTION OF DRAWINGS

In drawings which describe embodiments of the invention, but which should not be construed as restricting the spirit or scope thereof.

FIG. 5 is a perspective view of a lower track of the assembly of FIG. 1;

FIG. 6 is cross-sectional view taken along section lines 6-6 of FIG. 5 and looking in the direction of the arrows;

FIG. 7 is an enlarged, fragmented, side elevational view of tab connectors formed in the lower track;

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than restrictive, sense.

Figure 1:
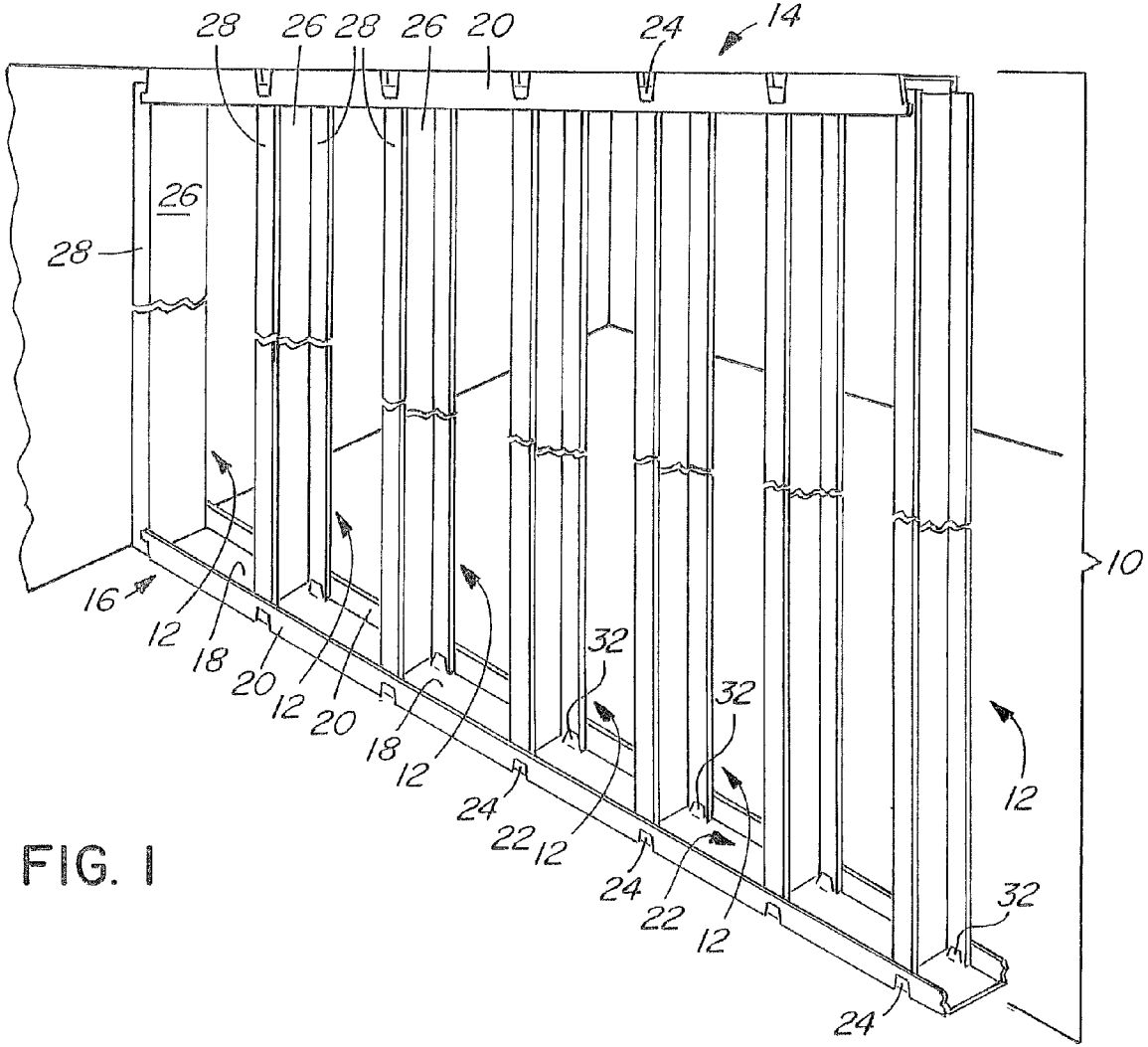
FIG. 1 is a fragmented, perspective view of a slip track assembly configured in accordance with an embodiment of the invention for supporting a plurality of spaced-apart wall studs.

This application relates to a track assembly 10 for supporting wall studs 12. With reference to FIG. 1, assembly 10 includes an upper track 14 attached to the ceiling framework of a building and a lower track 16 attached to the floor of a building. Each track 14, 16 includes a horizontal base surface 18 and a pair of opposed vertical sidewalls 20 extending generally perpendicular to base 18. Base 18 and sidewalls 20 together define a generally U-shaped trough 22. As described further below, each trough 22 is sized to receive an end portion 24 of a stud 12. The width of sidewall 20 and hence the depth of trough 22 may be larger in the upper track 14 (FIGS. 2-4) than the lower track 16 (FIGS. 5-7).

Figure 8:
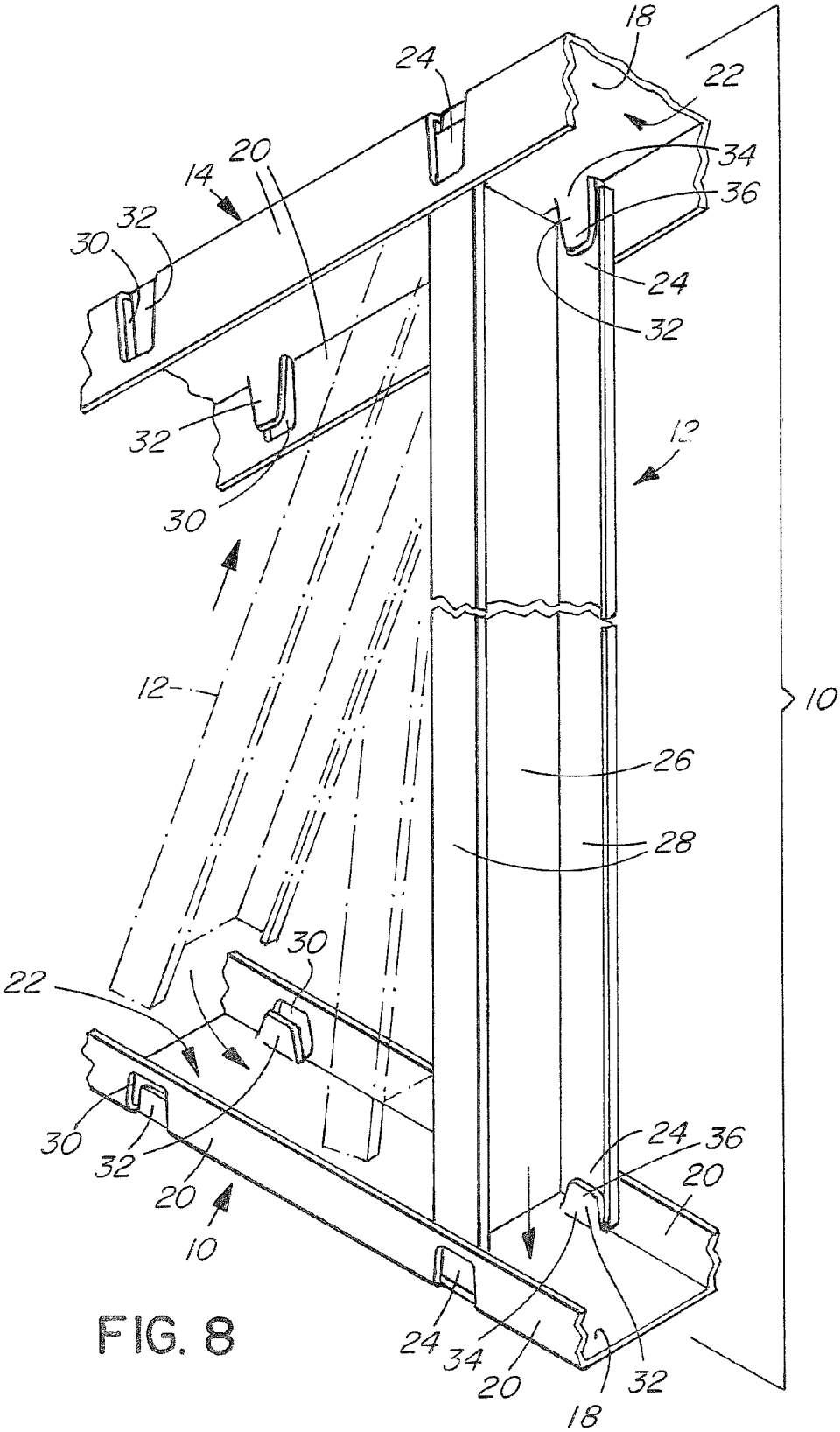
FIG. 8 is a fragmented, perspective view of the track assembly showing steps for releasably coupling a wall stud to the upper and lower tracks.

As shown best in FIG. 8, each stud 12 includes a base 26 and opposed flanges or sidewalls 28 extending in parallel planes perpendicular to base 26. Studs 12 are conventional in structure and are typically constructed of 12-25 gauge steel. Studs 12 can be cut to the desired length.

Figures 2, 3, 4:
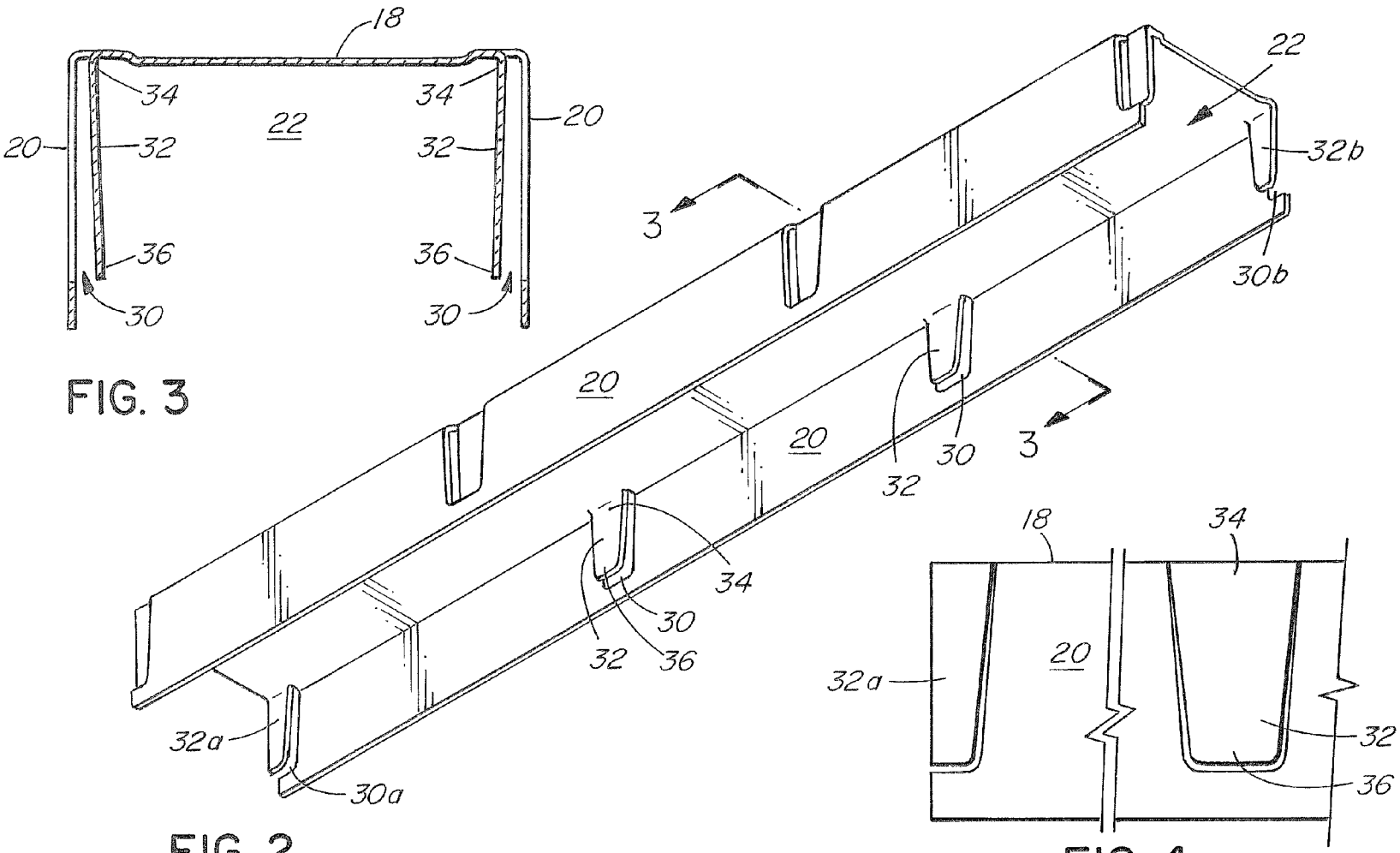
FIG. 2 is a perspective view of an upper track of the assembly of FIG. 1 in an inverted position with the track sidewalls projecting upwardly.
FIG. 3 is a cross-sectional view taken along section lines 3-3 of FIG. 2 and looking in the direction of the arrows.
FIG. 4 is an enlarged, fragmented, side elevational view of tab connectors formed in the upper track.

As shown in FIG. 2, a plurality of slots 30 are formed in the sidewalls 20 of each track 14, 16 at regular intervals. Slots 30 on opposed sidewalls 20 are preferably aligned. In one embodiment of the invention, each slot 30 is defined between a tab 32 and an adjacent portion of sidewall 20. Each tab 32 includes a fixed end 34 proximal to base 18 and a free end 36 located distal from base 18 (FIGS. 3-4 and 6-7). As described further below, in one embodiment of the invention each tab 32 may consist of a punched-out portion of a sidewall 20 formed in a metal press machine.

Slots 30 are preferably formed in each sidewall 20 at regular, spaced-apart longitudinal intervals. For example, the spacing between slots 30 may be within the range of approximately 8-24 inches. At respective ends of each track 14, 16 half slots 30(*a*) and 30(*b*) may be formed. Half slots 30(*a*) and 30(*b*) form a full slot 30 when end portions of two tracks 14, 16 are longitudinally aligned.

In one embodiment of the invention, each tab 32 may be generally trapezoidal in shape, tapering inwardly from fixed end 34 to free end 36 (FIGS. 4 and 7). As will be appreciated by a person skilled in the art, tabs 32 may be formed in other configurations to define slots 30 of other shapes and sizes. In the illustrated embodiment, the length of tabs 32 is longer in upper track 14 than lower track 16. In one illustrative embodiment of the invention, tabs 32 formed in upper track 14 (FIG. 4) are 1⅝ inches in length and taper from a width of 1 inch at fixed end 34 to a width of ¾ inches at free end 36. Tabs 32 formed in lower track 16 (FIG. 7) are approximately ¾ of an inch in length and taper from a width of 1 inch at fixed end 34 to a width of ⅞ of an inch at free end 36.

In use, upper track 14 is secured to a ceiling framework of a structure and lower track 16 is secured to the floor of the structure (FIG. 1). Tracks 14, 16 are preferably installed so that slots 30 formed in tracks 14, 16 are vertically aligned. End portions of some tracks 14, 16 may abut a wall, as shown in FIG. 1. Other end portions of tracks 14, 16 may be longitudinally aligned as described above to define troughs 22 of any desired length.

Figure 9:
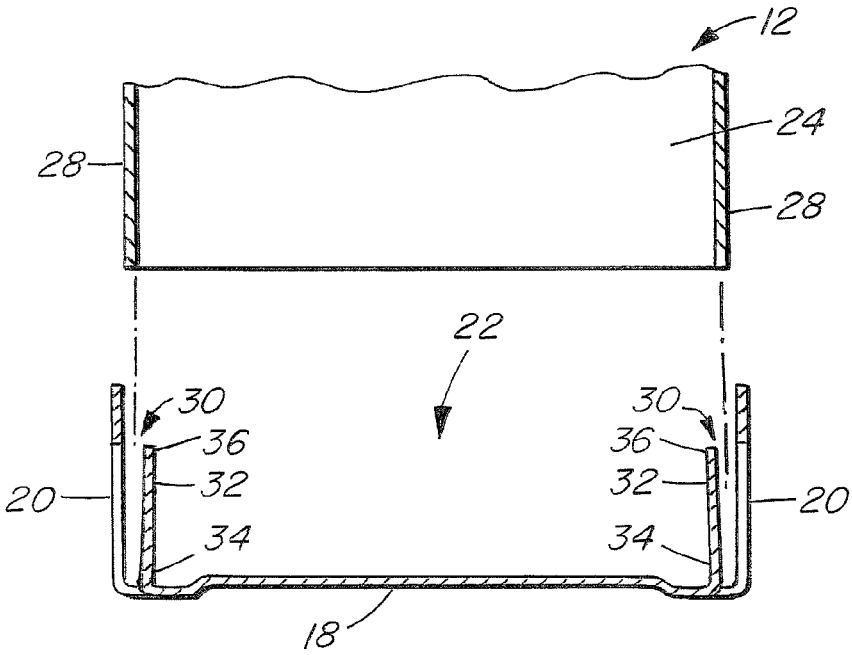
FIG. 9 is an enlarged, cross-sectional view showing a lower end of a wall stud disposed above a track slot.
Figure 10:
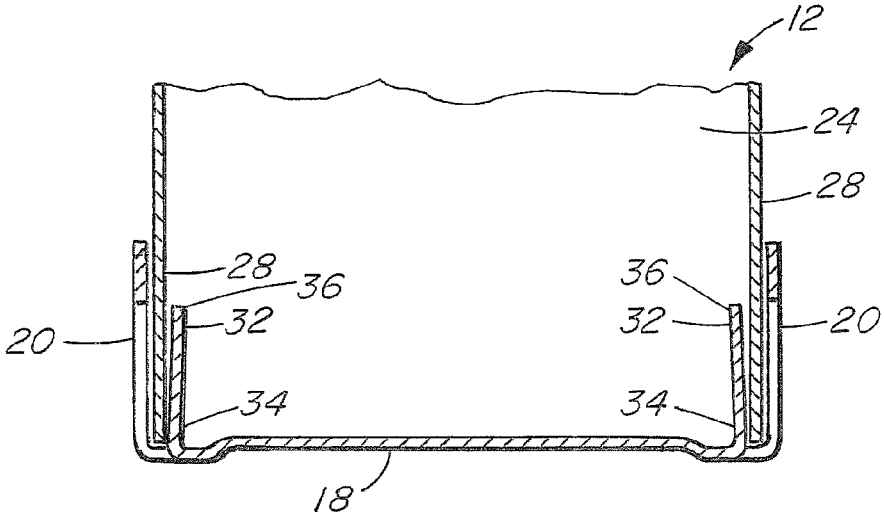
FIG. 10 is an enlarged, cross-sectional view showing a lower end of a wall stud seated within a track slot.

Standard studs 12 are cut to the desired length to extend between tracks 14, 16. Preferably studs 12 are cut to a length which is slightly less than the installed distance between bases 18 of aligned upper and lower tracks 14, 16. For example, studs 12 may be cut to a length which is approximately ⅛ of an inch shorter than the distance between bases 18 of upper and lower tracks 14, 16. As shown in FIG. 8, stud 12 may be secured to assembly 10 by first inserting one end portion 24 of stud 12 into trough 22 of upper track 14 so that sidewalls 28 at (upper) end portion 24 are received into opposed slots 30. The opposite (lower) end portion 24 of stud 12 is then pivoted into position (FIGS. 8-9) and dropped into aligned slots 30 of lower track 16 (FIG. 10). Once installed as aforesaid, the lowermost edge of stud 12 is supported on the base 18 of lower track 16 as shown in FIG. 10.

Since the length of stud 12 is slightly less than the distance between bases 18 of upper and lower tracks 14, 16, some relative movement of track assembly 10 and studs 12 is permitted. Such a "slip track" system permits the upper track 14 to shift vertically relative to studs 12 and lower track 16 if the ceiling height of the structure shifts or deflects. As will be appreciated by a person skilled in the art, changes in the relative spacing between the ceiling and floor of a structure causing deflection of track 14 may result from loads applied to the structure and/or temperature fluctuations causing expansion or contraction of structural components.

One significant advantage of the applicant's track assembly 10 is that stud 12 may be securely coupled to assembly 10 without the use of special tools or fasteners. That is, one (upper) end 24 of each stud 12 may be coupled to upper track 14 as described above (FIG. 8) by an installer standing on the floor of the structure and extending stud 12 upwardly toward the ceiling. Accordingly, ladders or additional braces or fasteners are not required. The opposite (lower) end 24 of each stud 12 may also be secured to lower track 16 as described above without the use of fasteners or special tools. Thus studs 12 may be easily installed at the correct locations and intervals and installation errors by unskilled tradesmen are avoided.

Another advantage of assembly 10 is that stud 12 may be connected to assembly 10 in any desired orientation (i.e. with sidewalls 28 of stud 12 extending either toward or away from an end wall of the structure). For example, FIG. 1 shows six studs 12 disposed in one orientation and one stud 12 adjacent to the end wall disposed in an opposite orientation. This allows studs 12 to be placed in the optimum orientation to suit the particular requirements of the wall in question.

A further advantage of assembly 10 is that one or more selected studs 12 may be easily removed from assembly 10 without the use of ladders or other special tools or equipment by reversing the installation procedure illustrated in FIG. 8, (i.e. by lifting stud 12 upwardly, pivoting one (lower) end 24 out of lower track 16 and then lowering stud 12 out of upper track 14 to de-couple it from assembly 10). It is often convenient to remove a stud 12 from an assembly 10 after initial installation to make room for electrical panels, plumbing or other building materials installed by sub-trades as construction of a structure progresses.

Figure 11:
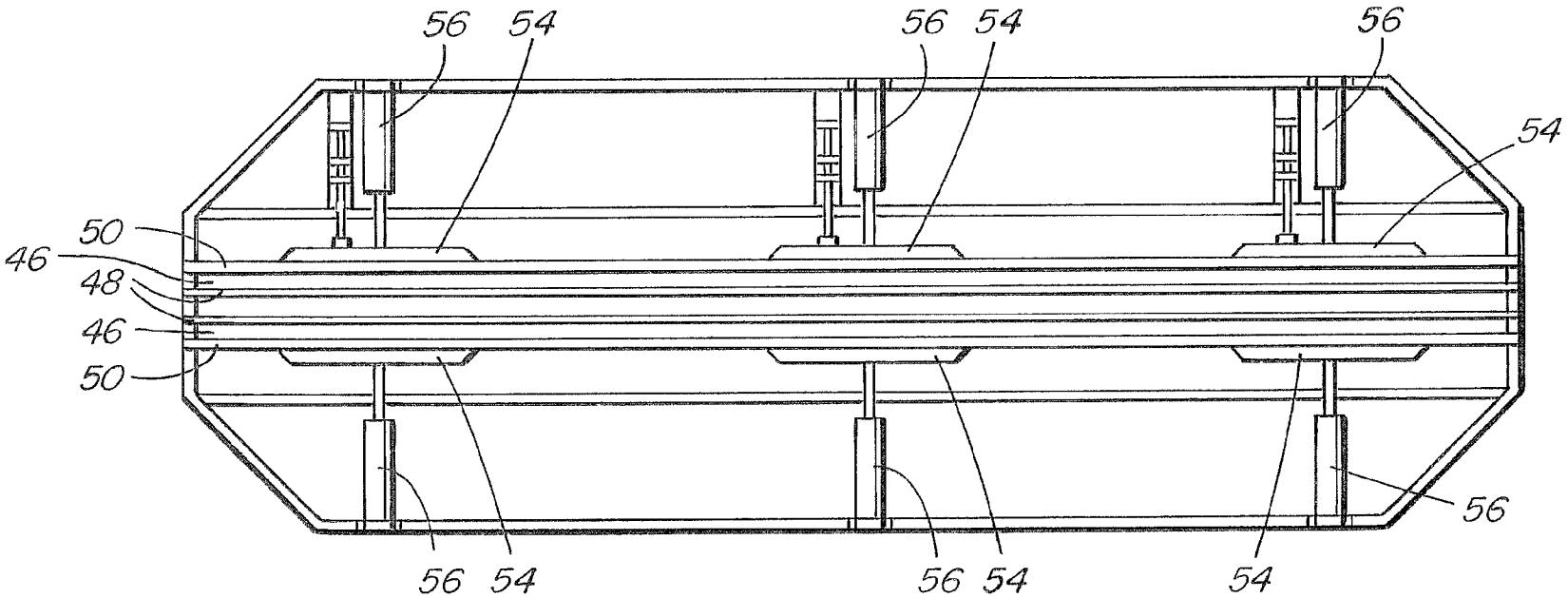
FIG. 11 is a top, plan view of a metal press for fabricating the tracks of the track assembly.
Figure 12:
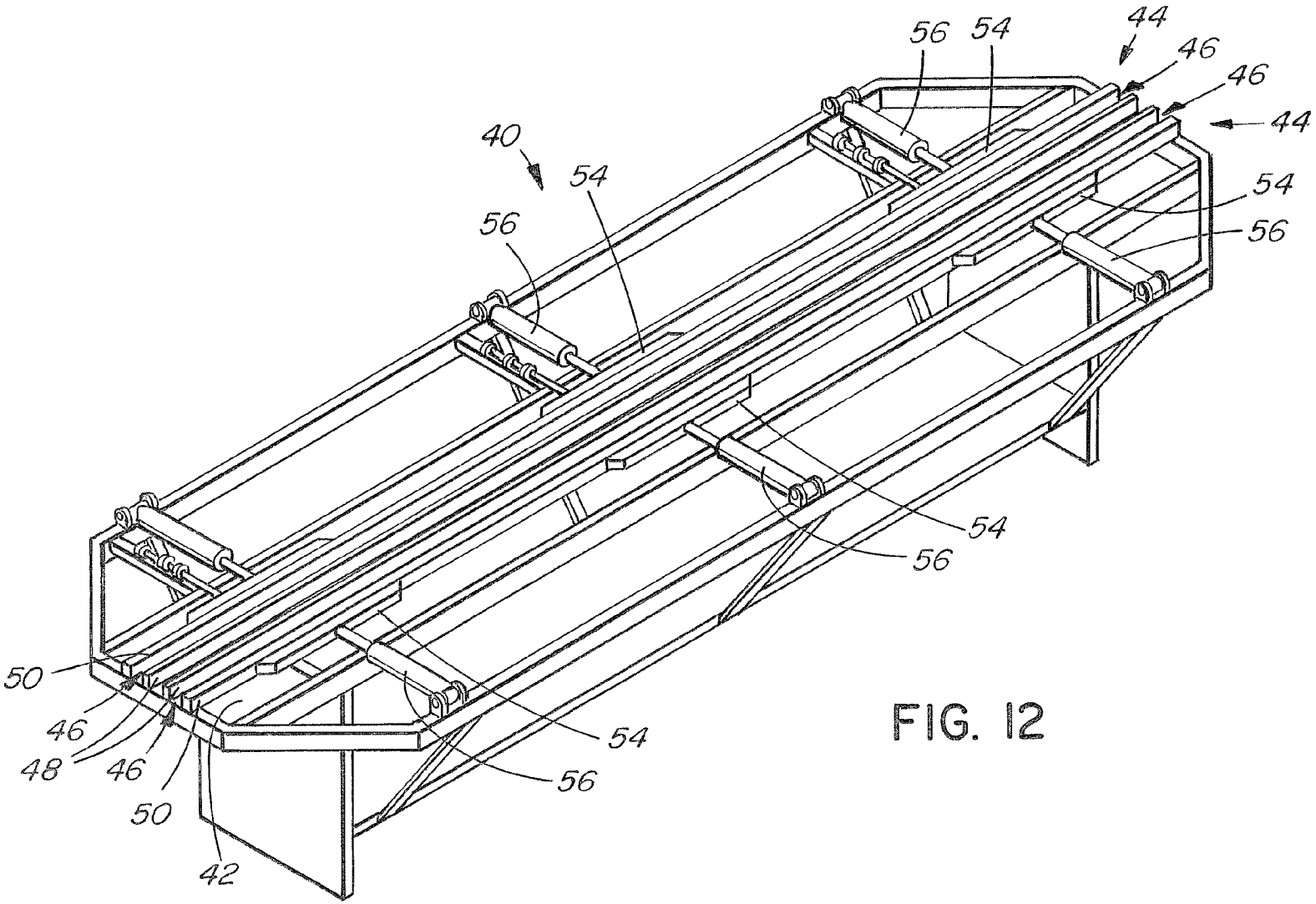
FIG. 12 is a top, perspective view of the press of FIG. 12.

FIG. 11 illustrates an embodiment of a metal press 40 for forming slots 30 in tracks 14, 16 of assembly 10 at the desired intervals. Press 40 includes a flat table 42 for receiving unslotted blanks of tracks 14, 16. More particularly, table 42 supports adjustable dies 44 which each include elongated slots 46 for receiving a sidewall 20 of a track 14, 16. An elongated female bar 48 and an elongated male punch bar 50 are positioned on opposite sides of each slot 46. In the illustrated embodiment, female bars 48 are located on the inner portion of each die 44 and male bars 50 are located on the outer portion of each die 44. Transverse spacers 52 (not shown) may extend at longitudinal intervals between respective female bars 48 to maintain track alignment. Press bars 54, actuated by hydraulic cylinders 56, bear against the outer surface of each male punch bar 50.

Figure 13:
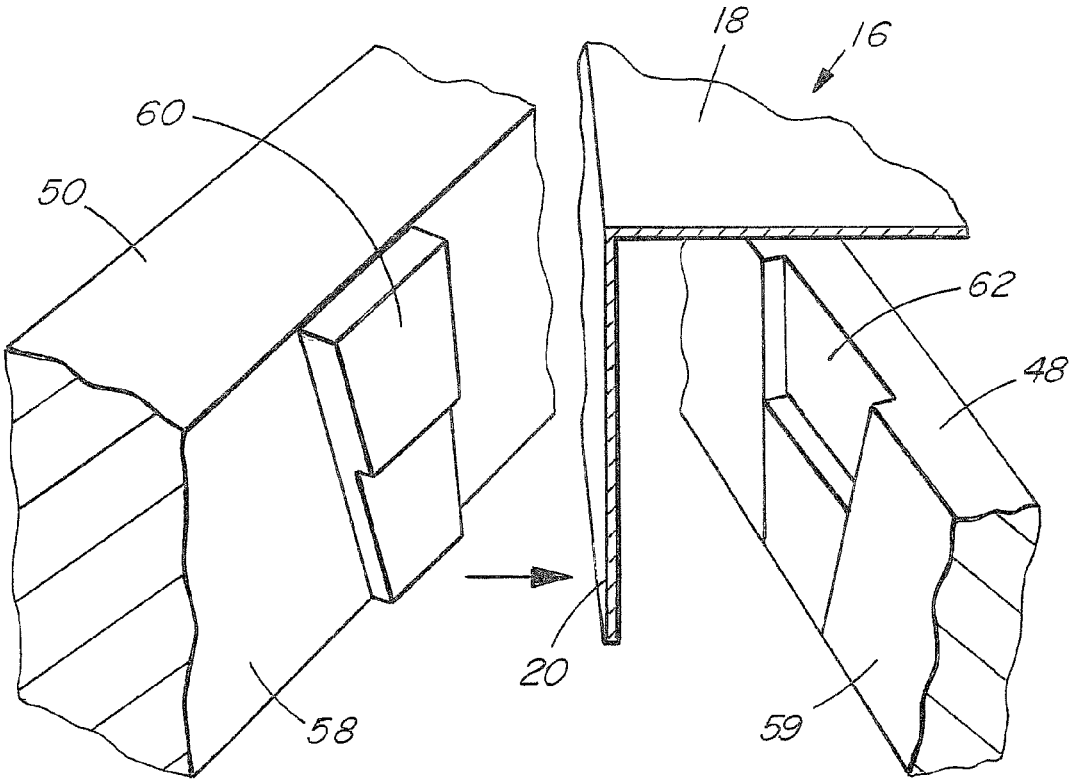
FIG. 13 is an enlarged, fragmented, perspective view of female and male punch bars for forming tabs in a track sidewall using the metal press of FIGS. 11 and 12.

As shown best in FIG. 13, an inner surface 58 of each male punch bar 50 includes a plurality of spaced-apart punches 60 which are shaped to form the desired tabs 32 in sidewalls 20. Punches 60 may be, for example, releasably bolted to inner surface 58 of male punch bar 50.

As shown in FIG. 13, an inner surface 59 of each female bar 48 has a cavity 62 formed therein sized for receiving a corresponding punch 60. In use, an unslotted blank track 14, 16 is placed on table 42 of metal press 40 with a respective sidewall 20 inserted within a respective die 44. When hydraulic cylinders 56 are actuated, press bars 54 forcibly press each male punch bar 50 against a respective female bar 48 to form a plurality of tabs 32 in each sidewall 20 at the desired intervals. As indicated above, tabs 32 are formed in the shape and size defined by punches 60. For example, punches 60 may be trapezoidal in shape. Punches 60 forming tabs 32(*a*) and 32(*b*) at end portions of tracks 14, 16 (FIGS. 2 and 5) may be smaller in size to form a full tab when they are aligned as described above.

As will be appreciated by a person skilled in the art, the position of dies 44 on table 42 may be adjustable to accommodate tracks 14, 16 of different sizes and gauges. Further, the number and spacing of punches 60 and cavities 62 is also readily adjustable to form track slots 30 of the desired shape, size and spacing.

As will be apparent to those skilled in the art in the light of the foregoing disclosure, many alternations and modifications are possible in the practice of this invention without departing from the spirit or scope thereof. Accordingly, the scope of the invention is to be construed in accordance with the substance defined by the following claims.

We claim:

1. A track for supporting an end portion of an elongated wall stud comprising:

(a) a longitudinally extending base;

(b) first and second opposed sidewalls extending generally perpendicular to said base in spaced-apart parallel planes, wherein said base and said sidewalls together define a trough for receiving and retaining said end portion of said stud; and (c) a plurality of tabs extending within the interior of said trough at spaced-apart longitudinal intervals, wherein pairs of said tabs are aligned, and wherein said tabs define a plurality of slots each defined between one of said tabs and one of said sidewalls for slidably receiving a wall panel of said stud, each of said tabs extending in a plane substantially parallel to the plane of said one of said sidewalls, each of said tabs comprising a fixed end located at said base and a free end located distal from said base and displaced from said one of said sidewalls to define a slot opening.

2. The track as defined in claim 1, wherein said tabs extend in a plane generally perpendicular to said base such that said tabs extend substantially vertically when said base is oriented horizontally.

3. The track as defined in claim 1, wherein each of said tabs is a substantially planar sheet.

4. The track as defined in claim 1, wherein each of said tabs is a punched-out portion of one of said sidewalls.

5. The track as defined in claim 1, wherein each of said tabs tapers from a maximum width at said fixed end to a minimum width at said free end.

6. The track as defined in claim 1, wherein at least some of said tabs are trapezoidal in shape.

7. The track as defined in claim 1, wherein tabs located at end portions of said track are more narrow than the remainder of said tabs.

8. The track as defined in claim 1, wherein each of said slots is vertically oriented, said slot opening being at a location of said tab furthest from said base.

9. The track as defined in claim 1, wherein said spaced-apart longitudinal intervals are within the range of between 8-24 inches.

10. The track as defined in claim 9, wherein said intervals are regularly spaced.

11. The track as defined in claim 1, wherein said track is constructed of metal within the range of 12-25 gauge.

12. The track as defined in claim 11, wherein said track is less than 18 gauge.

13. The track as defined in claim 2, wherein said stud is adjustable relative to said track between engaged and disengaged positions, and wherein said tabs substantially restrain non-vertical movement of said stud within said trough in said engaged position.

14. The track as defined in claim 13, wherein said stud is adjustable between said engaged and disengaged positions by sliding said stud vertically.

15. An assembly comprising a plurality of tracks as defined in claim 1 aligned end to end such that the troughs of each track are linearly aligned.

16. A track and stud assembly comprising a first track and second track each as defined in claim 1 and a stud extending therebetween, wherein said slots permit a limited degree of relative sliding movement of said tracks and said stud.

17. The assembly as defined in claim 16, wherein the base of said first track extends in a plane parallel to the base of said second track at a distance greater than the length of said stud to permit said relative sliding movement.

18. The assembly as defined in claim 16, wherein the trough of said first track has a depth exceeding a depth of the trough of said second track.

19. The assembly as defined in claim 16, wherein said tabs of said first track have a length exceeding said tabs of said second track to define corresponding larger slots in said first track.

20. The assembly as defined in claim 16, wherein said first track is oriented above said second track and said stud is vertically positionable therebetween.

21. The track as defined in claim 1, wherein the bottom of each of said slots is at approximately the same elevation as said base, whereby each of said slots is adapted to slidably receive a stud having a flat bottom edge.

* * * * *